US008579265B1

(12) United States Patent
Chen

(10) Patent No.: US 8,579,265 B1
(45) Date of Patent: Nov. 12, 2013

(54) SIMPLE START RATCHET-TYPE CARBURETOR

(71) Applicant: Qian Chen, Zhejiang (CN)

(72) Inventor: Qian Chen, Zhejiang (CN)

( * ) Notice: Subject to any disclaimer, the term of this patent is extended or adjusted under 35 U.S.C. 154(b) by 0 days.

(21) Appl. No.: 13/677,313

(22) Filed: Nov. 15, 2012

(30) Foreign Application Priority Data

Aug. 21, 2012 (CN) ..... 2012 1 0315042

(51) Int. Cl.
*F02M 1/04* (2006.01)

(52) U.S. Cl.
USPC ..... 261/34.1; 261/35; 261/66; 261/69.1; 261/DIG. 8; 261/DIG. 38

(58) Field of Classification Search
USPC ..... 261/34.1, 35, 66, 69.1, 69.2, DIG. 8, 261/DIG. 38, DIG. 68
See application file for complete search history.

(56) References Cited

U.S. PATENT DOCUMENTS 2,291,654 A * 8/1942 Samiran ..... 123/458
3,767,173 A * 10/1973 Ishii ..... 261/36.2
3,834,359 A * 9/1974 Ando ..... 123/1 A
4,824,613 A * 4/1989 Scott et al. ..... 261/35
5,740,781 A * 4/1998 Scott et al. ..... 123/437
6,042,088 A * 3/2000 Wang ..... 261/39.1
6,152,431 A * 11/2000 Stenz et al. ..... 261/34.1
6,595,500 B2 * 7/2003 Osburg et al. ..... 261/34.2
6,938,884 B2 * 9/2005 Knaus et al. ..... 261/34.2
7,467,785 B2 * 12/2008 Braun ..... 261/34.2
2003/0079729 A1 * 5/2003 Kunimitsu et al. ..... 123/572
2008/0061454 A1 * 3/2008 Braun ..... 261/35

FOREIGN PATENT DOCUMENTS

JP 3-242455 A * 10/1991 ..... 261/DIG. 8

* cited by examiner

*Primary Examiner* — Richard L Chiesa

(57) ABSTRACT

A simple start ratchet-type carburetor includes a carburetor body, an inlet tube communicated with the carburetor body for forming a fuel passage, a fuel passage of a measuring room, a main fuel supply cavity molded integrally with the carburetor body comprising a choke subassembly, a venturi, and a throttle subassembly. The end of the throttle shaft protruding from the carburetor body provides a first pawl, a second pawl and a hand cranking block, the two pawls are mounted on one end of the throttle shaft by a fastener, the hand cranking block is mounted on the other end, the end of the choke shaft protruding from the carburetor body provides a first ratchet and a second ratchet. An air removing device drives the ratchets to rotate the choke shaft which controls the opening or closing of a shut-off valve device. The carburetor can control precisely the fuel amount.

8 Claims, 8 Drawing Sheets

C — C

SIMPLE START RATCHET-TYPE CARBURETOR

FIELD OF THE INVENTION

The present invention relates to a carburetor, and more particularly to a simple start ratchet-type carburetor.

BACKGROUND OF THE INVENTION

The development of economy provides a good development platform for the progress of universal gasoline engine. Carburetor, an assistant device for universal gasoline engine, is also progressed as a result of the boom of universal gasoline engine industry.

The carburetor is a device that introduces fuel into the airstream as it flows into the engine. When the engine is started, a very rich air/fuel mixture is required, thus the air-supply channel of the carburetor should be closed so as to provide the richer mixture. However, the engine probably fails to start by simply closing the air-supply channel, because many external factors, such as environmental temperature, moisture and the engine, can decrease the concentration of fuel in the mixing chamber.

SUMMARY OF THE INVENTION

The invention provides a simple start carburetor having a structure of ratchet, which can control the amount of fuel pumped into the carburetor.

The invention fulfills the foregoing object by providing a simple start ratchet-type carburetor, comprising a carburetor body, an inlet tube communicated with the carburetor body for forming a fuel passage, a fuel passage of a measuring room arranged in the carburetor, a main fuel supply cavity molded integrally with the carburetor body which comprises a choke subassembly, a venturi, and a throttle subassembly, with the choke subassembly comprising a choke plate and a choke shaft, and the choke plate being mounted on the choke shaft, the throttle subassembly comprising a throttle plate and a throttle shaft, and the throttle plate being mounted on the throttle shaft by a screw, the choke shaft and the throttle shaft both being pivotally connected to the carburetor body, and two ends of both the choke shaft and the throttle shaft being protruded from the carburetor body to form linkages ends and control ends respectively. The end of the throttle shaft protruding from the carburetor body provides a first pawl, a second pawl and a hand cranking block, the first pawl and the second pawl both are mounted on one end of the throttle shaft by a fastener which limits the location between the pawls and the throttle shaft, while the hand cranking block is mounted on the other end of the throttle shaft, the end of the choke shaft protruding from the carburetor body provides a first ratchet and a second ratchet, the first ratchet and the second ratchet are mounted on one end which is the same end for the first pawl and the second pawl to mount thereon of the throttle shaft, by a fastener which limits the location between the ratchets and the choke shaft. The carburetor body further comprises an air removing device consisting of two fuel pipes, a valve rod, a swing block, a fuel pumping ball seat and a fuel pumping ball located on the fuel pumping ball seat, two ends of each fuel pipe are connected with the fuel pumping ball seat and the carburetor body respectively to form a fuel passage, one end of the valve rod is mounted on the fuel pumping ball seat, and the other end has a flexible connection with the swing block. The movement of the swing block provided by the air removing device drives the first ratchet, the second ratchet, the first pawl and the second pawl which forms a ratchet mechanism.

Preferably, the carburetor body further comprises a shut-off valve device, the air removing device drives the first ratchet and the second ratchet, so as to rotate the choke shaft, then the choke shaft controls opening or closing of the shut-off valve device.

Preferably, the edge of the second ratchet consists of twelve teeth, and the profile angle between two teeth is 25°, while the first ratchet has a step, at least one tooth and a notch between them, the first ratchet is mounted between the carburetor body and the second ratchet.

Preferably, the choke shaft consists of a choke linkage shaft and a choke control shaft which could move relative to the choke linkage shaft, the choke linkage shaft is located through the choke control shaft and is arranged in the carburetor body, the end of the choke control shaft located in the carburetor body provides an open slot, while the inner cavity of the choke plate provides a protrusion that locks with the open slot. One end of the choke is pressed against a toroidal step provided by the choke linkage shaft, and the other end is pressed against the open slot provided by the choke control shaft.

Preferably, the choke linkage shaft has a recess, which is presented as a semi-torus structure.

Preferably, the shut-off valve device consists of a fuel passage molded integrally with the carburetor body, and a needle valve, a valve seat and a flexible element within the fuel passage, the cavity of the valve seat provides a movable block which has the needle valve inserted therein, one end of the flexible element is elastically pressed against the fuel passage, and the other end is elastically pressed against a locating torus provided by the valve seat, the shut-off valve device is connected with the main fuel supply cavity via a fuel passage.

Preferably, a pressure spring is provided between the cavity of the valve seat and the movable block.

Preferably, there is a line contact or a surface contact between the recess and the outer surface of the valve seat.

When an operator needs to start the simple start ratchet-type carburetor provided by the present invention, the operator presses the fuel pumping ball to drive downward the swing block, so as to drive the teeth of the two ratchets to rotate the choke shaft, then the choke plate is closed as the fuel pumping ball has been pressed for 3 times, and fuel from a fuel tank enters the fuel pumping ball through the measuring room of the carburetor, one portion of the fuel then flows to the fuel tank and the other portion flows into the shut-off valve device, at this point, the choke linkage shaft rotates with the guide of the rotation of the second ratchet, such that the needle valve moves outward gradually while the shut-off device is still closed even though the fuel pumping ball has been pressed for 1-3 times, however, the needle valve can be opened as the fuel pumping ball has been pressed for 4-6 times so as to make the fuel enter the main fuel supply cavity, further pressing the fuel pumping ball can close the needle valve and the fuel cannot enter the main fuel supply cavity anymore, the second ratchet will no longer rotate anymore since the fuel pumping ball has been pressed for 8 times, additionally, the choke linkage shaft will also not drove by the second ratchet, consequently, the operator's further pressing the fuel pumping ball will not bump fuel into the main fuel supply cavity, as a result, the amount of fuel within the carburetor can be controlled. In the meantime, air in the fuel pumping ball is removed when the operator presses the ball, this enriches air/fuel mixture in the engine, which contribute to a successful start of the engine, in addition, an infinite pressing of the fuel pumping ball will not cause an excessive amount of fuel to enter the engine, which might lead to a false start of the engine.

DETAILED DESCRIPTION OF THE PREFERRED EMBODIMENTS OF THE INVENTION

Figure 1:
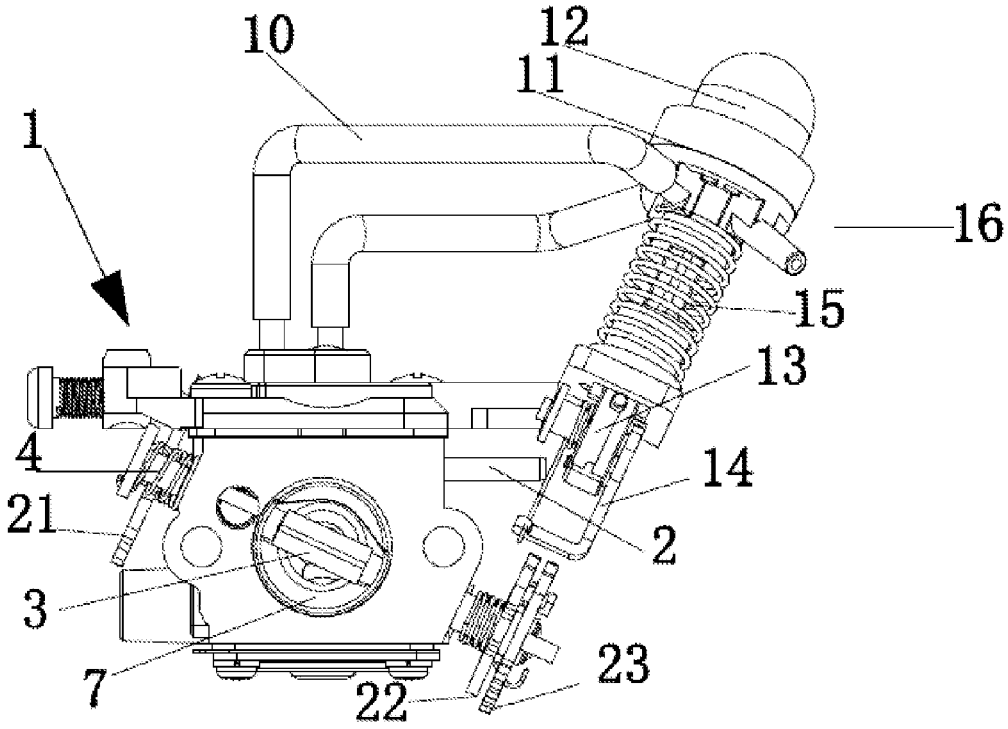
FIG. 1 is a front elevational view of the carburetor of the invention.
Figure 2:
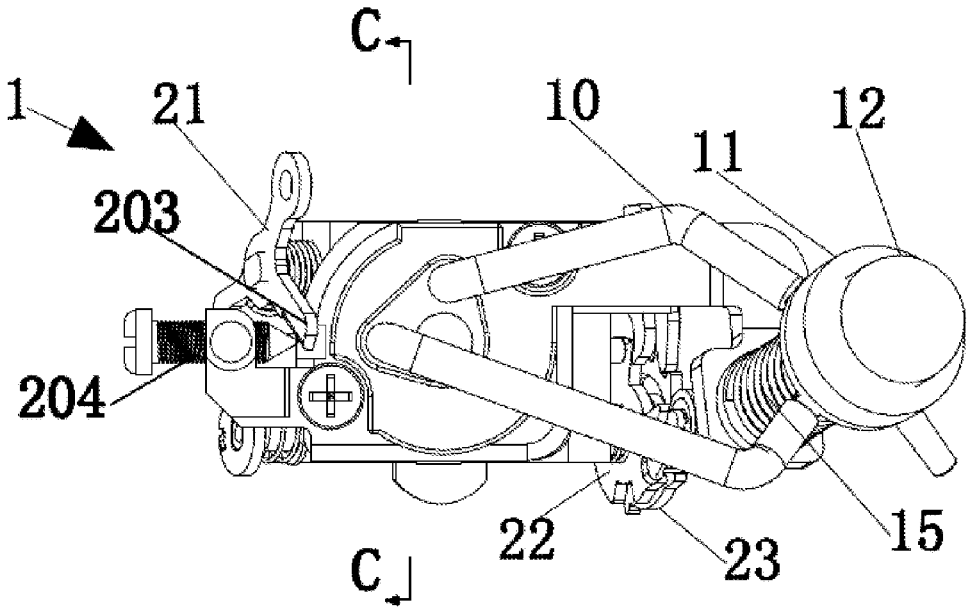
FIG. 2 is a top elevational view of the carburetor as viewed in FIG. 1.
Figure 3:
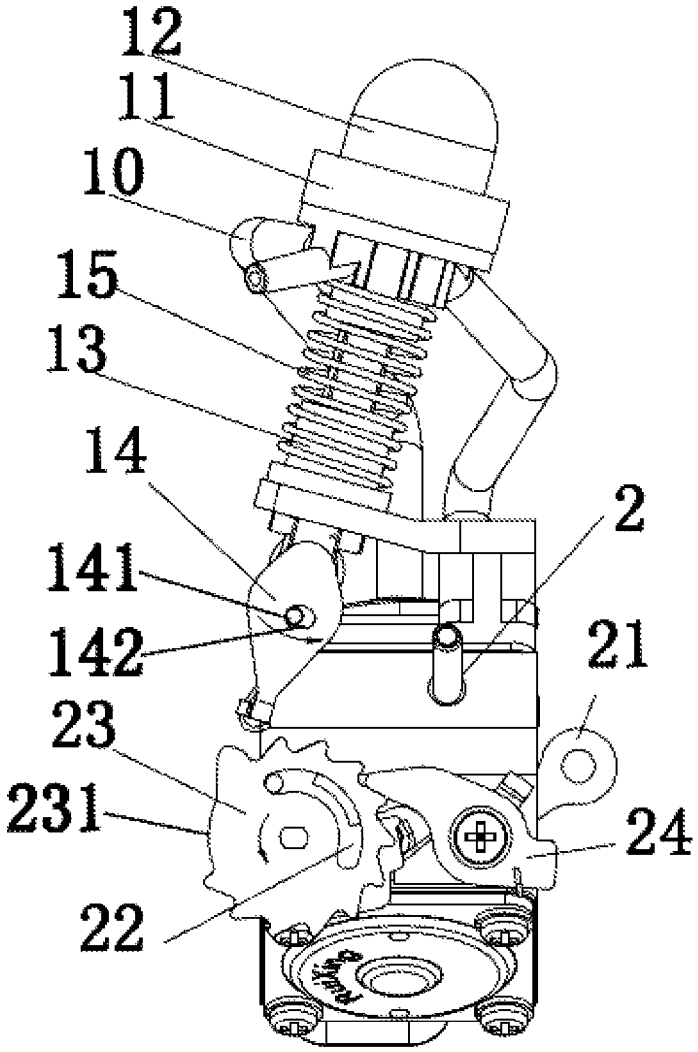
FIG. 3 is a side elevational view of the right hand side of the carburetor as viewed in FIG. 1.
Figure 4:
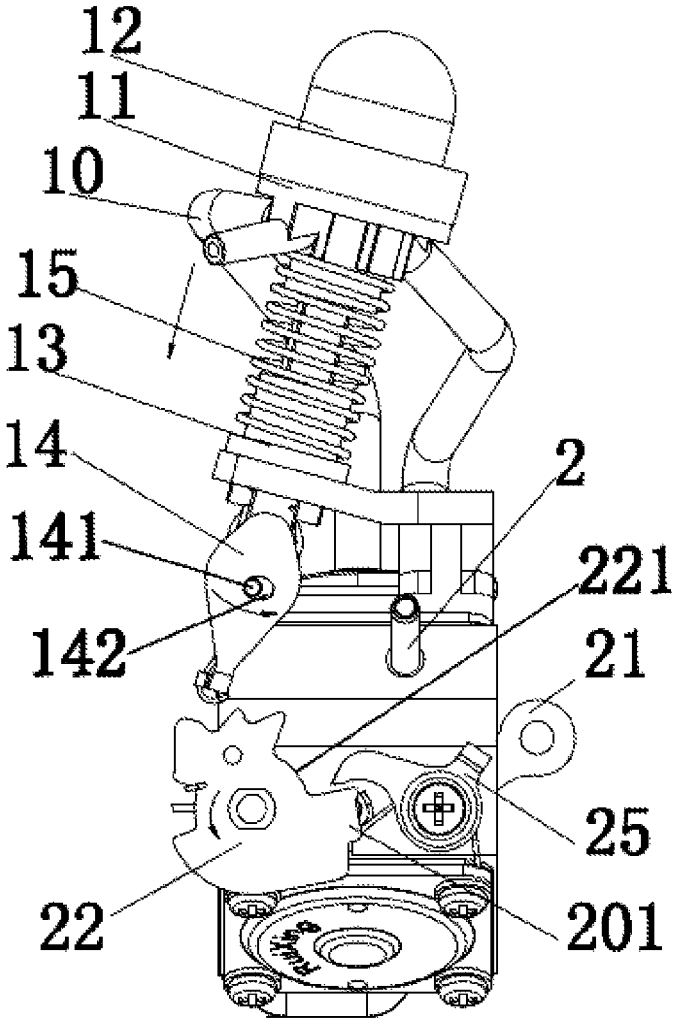
FIG. 4 is a right hand side view of the carburetor as viewed in FIG. 3 but removing the second ratchet and the first pawl.
Figure 5:
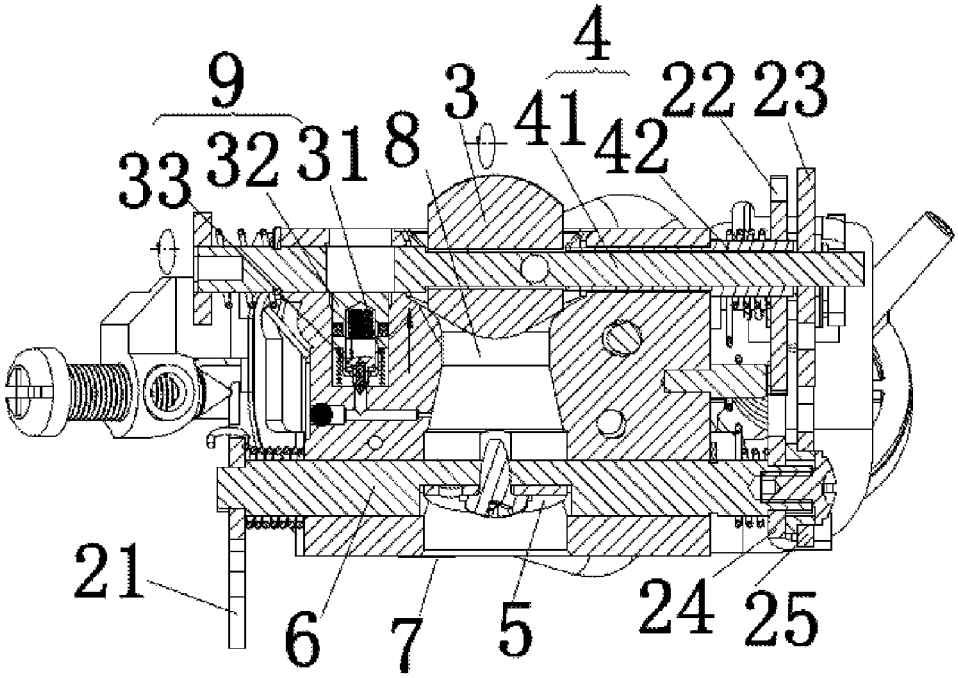
FIG. 5 is a cross sectional view of the carburetor of the invention.

Referring to FIG. 1-5, a simple start ratchet-type carburetor as an embodiment of the present invention comprises a carburetor body 1, an inlet tube 2 communicating with the carburetor body for forming a fuel passage, a fuel passage of a measuring room arranged in the carburetor, a choke shaft 4, a interlinked fuel passage consisting of two fuel pipes mounted on an air removing device 16 and a shut-off valve device 9 communicated with each other, a main fuel supply cavity 7 molded integrally with the carburetor body. The main fuel supply cavity 7 comprises a choke subassembly, a venturi 8, and a throttle subassembly. The choke subassembly comprises a choke plate 3 and a choke shaft 4, and the choke plate 3 is mounted on the choke shaft 4, while the throttle subassembly comprises a throttle plate 5 and a throttle shaft 6, and the throttle plate 5 is mounted on the throttle shaft 6 by a screw, the choke shaft 4 and the throttle shaft 6 both are pivotally connected to the carburetor body, and two ends of both the choke shaft 4 and the throttle shaft 6 protrude from the carburetor body to form linkages ends and control ends respectively. The end of the throttle shaft 6 protruding from the carburetor body provides a first pawl 24, a second pawl 25 and a hand cranking block 21, the first pawl 24 and the second pawl 25 are mounted on one end of the throttle shaft 6 by a torsional spring fastener which limits the location between the pawls and the throttle shaft, while the hand cranking block 21 is mounted on the other end of the throttle shaft, the end of the choke shaft 4 protruding from the carburetor body provides a first ratchet 22 and a second ratchet 23, the first ratchet 22 and the second ratchet 23 are mounted on one end which is the same end for the first pawl 24 and the second pawl 25 to mount thereon of the throttle shaft, by a torsional spring fastener which can limits the location between the ratchets and the choke shaft. The carburetor body further comprises an air removing device 16 consisting of two fuel pipes 10, a valve rod 13, a swing block 14, a fuel pumping ball seat 11 and a fuel pumping ball 12 located on the seat, two ends of each fuel pipes 10 are connected with the fuel pumping ball seat 11 and the carburetor body 1 respectively to form a fuel passage, one end of the valve rod 13 is mounted on the fuel pumping ball seat, and the other end has a flexible connection with the swing block 14. The end surface of the valve rod 13 mounted on the upper part of the carburetor body is communicated with the fuel pumping ball seat 11 via a spring 15 providing a force to make the air removing device 16 retune. The movement of the swing block 14 provided by the air removing device drives the first ratchet 22, the second ratchet 23, the first pawl 24 and the second pawl 25 which forms a ratchet mechanism, wherein a step 201 provided by the first ratchet 22 and the notch between ratchet teeth provided by the second ratchet 23 held the first pawl 24 and the second pawl 25 respectively at this point, pressing the fuel pumping ball 12 can again make the swing block 14 drive the first ratchet 22 and the second ratchet 23, accordingly, each pawl is hold by their corresponding step or notch of the ratchet. However, since the fuel pumping ball has been pressed for 3 times, further pressing cannot rotate the first ratchet 22 anymore because a notch 211 provided by the first ratchet 22 cannot press against the swing block 14, but the second ratchet 23 can still rotate since it has continuous ratchet teeth pressed against the swing block 14 driven by the pressing of the fuel pumping ball, while this rotation comes to an end since the fuel pumping ball has been pressed for 8 times, that is, the second ratchet 23 will not rotate by the ninth pressing because of the contact between the first pawl 24 and a notch 231 provided by second ratchet 23.

Preferably, the carburetor body 1 further comprises a shut-off valve device 9, the air removing device 16 drives the first ratchet and the second ratchet, so as to rotate the choke shaft 4, then the choke shaft 4 controls opening or closing the shut-off valve device 9. The shut-off valve device 9 consists of a fuel passage molded integrally with the carburetor body, and a needle valve 33, a valve seat 32 and a flexible element 31 within the fuel passage, the cavity of the valve seat 32 provides a movable block 301 which has the needle valve 33 inserted therein, one end of the flexible element 31 is elastically pressed against the fuel passage, and the other end is elastically pressed against a locating torus provided by the valve seat 32, the shut-off valve device 9 is connected with the main fuel supply cavity 7 via a fuel passage, and a pressure spring 302 is provided between the cavity of the seat and the movable block, choke linkage shaft 41 has a recess 401, which is presented as a semi-torus structure, and there is a line contact or a surface contact between the recess 401 and the outer surface of the valve seat 32.

The edge of the second ratchet 23 consists of twelve teeth, and the profile angle between two teeth is 25°. The first ratchet 22 has a step 201, at least one tooth and a notch 221 between them, the choke plate 3 will be closed by continuously pressing the fuel pumping ball for 3 times, at this time, the first ratchet 22 rotates 75°, because the first ratchet 22's first tree teeth have the same positions with that of the second ratchet 23, the needle valve 33 within the shut-off device 9 will not be open at this point.

Preferably, the choke shaft 4 consists of a choke linkage shaft 41 and a choke control shaft 42 which could move relative to the choke linkage shaft, the choke linkage shaft 41 is located through the choke control shaft 42 and is arranged in the carburetor body 1, the end of the choke control shaft 42 located in the carburetor body provides an open slot 101, while the inner cavity of the choke plate provides a protrusion 102 that locks with the open slot. One end of the choke plate 3 is pressed against a toroidal step provided by the choke linkage shaft 41, and the other end is pressed against the open slot 101 of the choke control shaft 42, so as to avoid the choke plate's axial endplay, the choke linkage shaft 41 can then drive the valve seat within the shut-off device 9 to opening or closing the needle valve 33.

Figure 6:
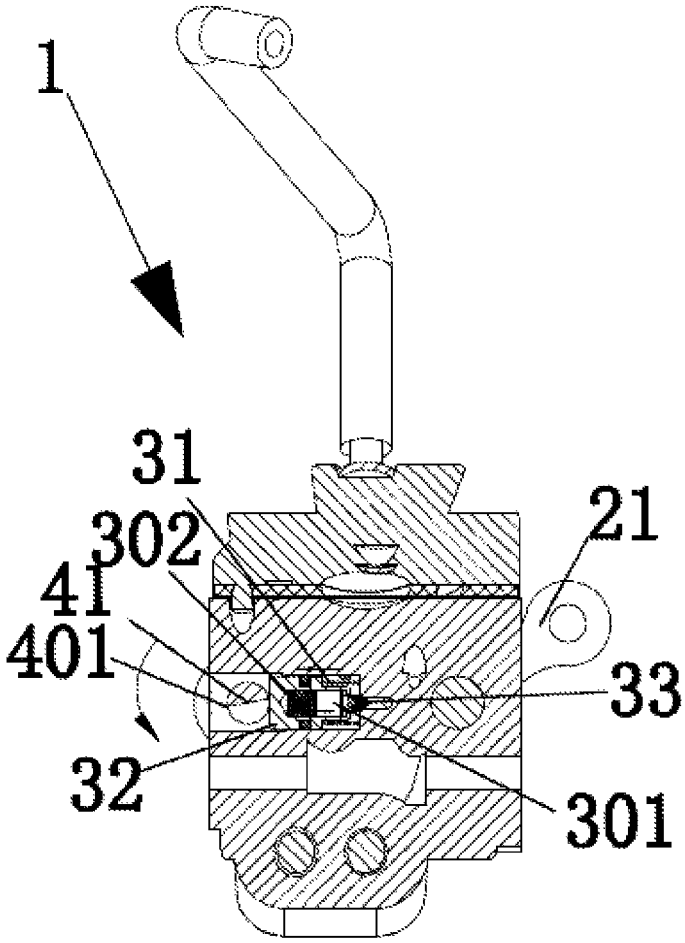
FIG. 6 is a cross sectional view taken on the line C-C of FIG. 2.
Figure 7:
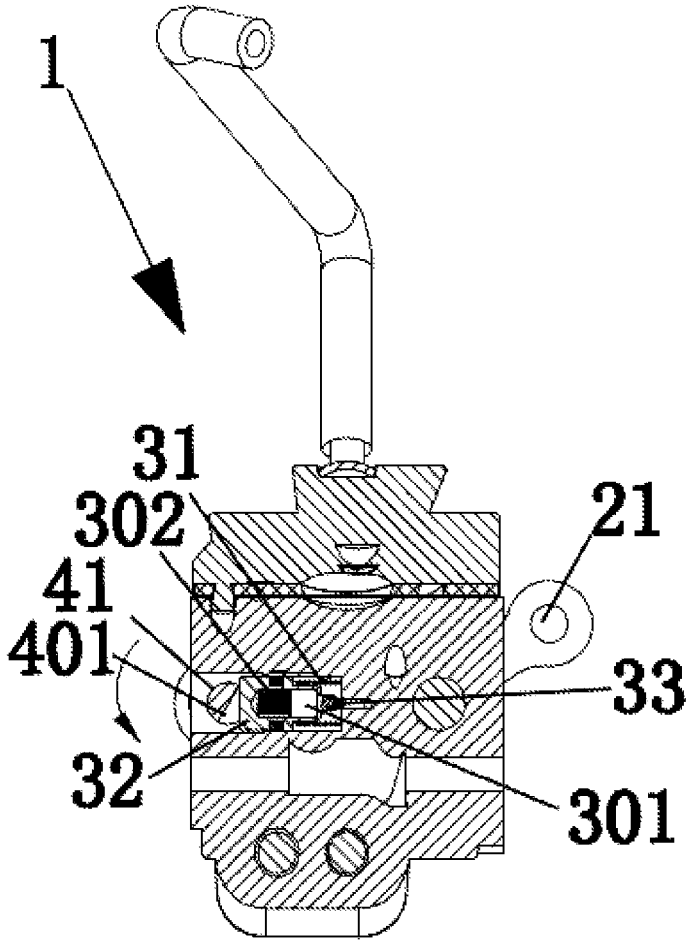
FIG. 7 is a cross sectional view as viewed in FIG. 6 with the needle valve is open.

Taken in conjunction with the accompanying drawings FIG. 1-5 (mentioned above) and FIG. 6-7, the work principle of this simple start ratchet-type carburetor of the present invention will be illustrated in detail. Before the engine starts, the choke plate 3 is in an open state, and the throttle plate 5 of the main fuel supply cavity 7 is in a close state, when there is a need to cold-start the engine, the air removing device 16 consists of two fuel pipes 10, a valve rod 13, a swing block 14, a fuel pumping ball seat 11 and a fuel pumping ball 12 located on the seat, two ends of each fuel pipes 10 are connected with the fuel pumping ball seat 11 and the carburetor body 1 to form a fuel passage, one end of the valve rod 13 is mounted on the fuel pumping ball seat, and the other end has a flexible connection with the swing block 14, wherein the linkage refers to a sliding recess 142 provided by the swing block 14 cooperating with a round-end protrution 141 provided by the end of the valve rod. The end of the throttle shaft 6 protruding from the carburetor body provides a first pawl 24, a second pawl 25 and a hand cranking block 21, the first pawl 24 and the second pawl 25 are mounted on one end of the throttle shaft 6 by a fastener which limits the location between the pawls and the throttle shaft, while the hand cranking block 21 is mounted on the other end of the throttle shaft, the end of the choke shaft 4 protruding from the carburetor body provides a first ratchet 22 and a second ratchet 23, the first ratchet 22 and the second ratchet 23 are mounted on one end which is the same end for the first pawl and the second pawl to mount thereon of the throttle shaft 6, by a fastener which limits the location between the ratchets and the choke shaft. The carburetor body 1 further comprises a shut-off valve device 9, the air removing device 16 drives the first ratchet and the second ratchet, so as to rotate the choke shaft 4, then the choke control shaft 42 controls opening or closing of the choke plate, while the choke linkage shaft 41 controls the opening or closing of the shut-off valve device 9. The shut-off valve device 9 consists of a fuel passage molded integrally with the carburetor body, and a needle valve 33, a valve seat 32 and a flexible element 31 within the fuel passage, the cavity of the valve seat 32 provides a movable block 301 which has the needle valve 33 inserted therein, one end of the flexible element 31 is elastically pressed against the fuel passage, and the other end is elastically pressed against a locating torus provided by the valve seat 32, the shut-off valve device 9 is connected with the main fuel supply cavity 7 via a fuel passage, and a pressure spring 302 is provided between the cavity of the seat and the movable block, the choke linkage shaft 41 has a recess 401, which is presented as a semi-torus structure, and there is a line contact or a surface contact between the slot 401 and the outer surface of the valve seat 32. The carburetor can be controlled by the above air removing device 16, the shut-off valve device 9, and the ratchet device, pressing the fuel pumping ball can drive the swing block 14 to press against ratchets at intervals and to push forward both the first ratchet 22 and the second ratchet 23, when the first ratchet 22 and the second ratchet 23 rotate to a certain degree, the pawls can be hold by the corresponding teeth of the ratchets, and the choke plate 3 is fully closed since the first ratchet 22 and the second ratchet 23 have rotated for 3 times, however, because the first pawl 24 can be hold by the notch 221 but not the teeth of first ratchet 22, the first ratchet 22 will not rotate along with the second ratchet 23 while the latter can still rotate for the fourth time, in addition, this continual rotating of the second ratchet 23 then drives the shut-off device 9 because of the relative rotating between the choke linkage shaft 41 and the choke control shaft 42, thus further pressing the fuel pumping ball can open the shut-off device to introduce fuel into the main fuel supply cavity 7, consequently, a certain amount of fuel can be introduced into the main fuel supply cavity as pressing the fuel pumping ball 12, which makes the engine in a cold state easy start. In order to make the engine work normally after it starts, an operator only need to rotate the hand cranking block 21 to release the second pawl 25, such that the first pawl 24 can also be drove by a clamping element provided at the end of the second pawl 25, then the first ratchet 22 and the second ratchet 23 both return to their original positions rapidly with the aid of the torsional spring, at this point the choke plate 3 is open, while opening or closing of the throttle plate 5 is controlled by the hand cranking block 21. A locating protrusion 203 at one terminal of the hand cranking block body 21 is pressed against the tip of a throttle plate adjusting screw 204 mounted at one end of the carburetor body, once the operator rotates the hand cranking block 21, the locating protrusion can be hold by the throttle plate adjusting screw 204 when the hand cranking block 21 returns with the help of a torsional spring, this is an easy operation for the operator, and it is convenient for the engine to be held at an idle position after it starts.

Figure 8:
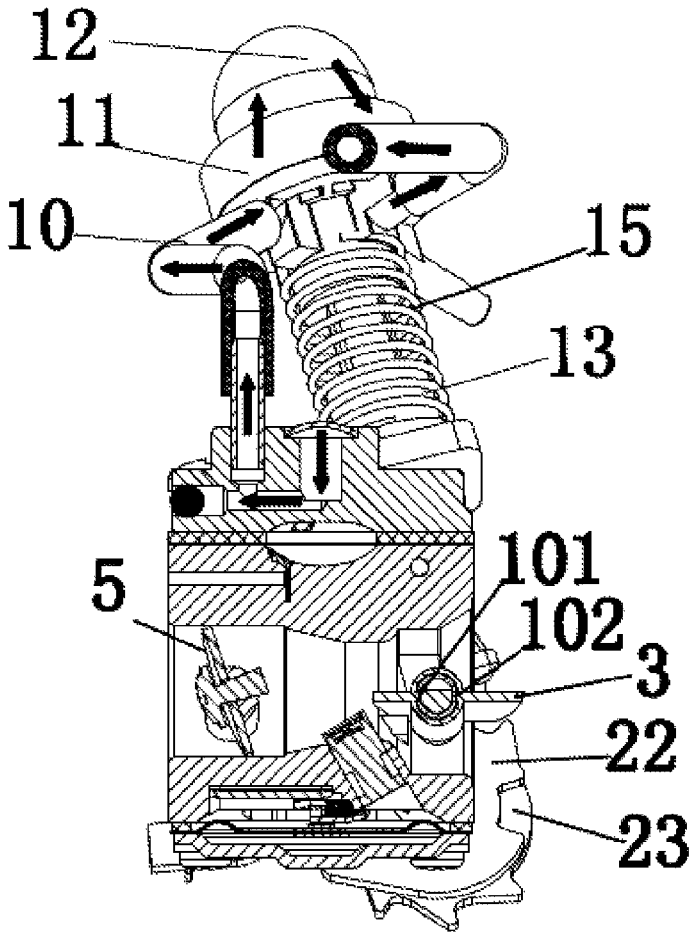
FIG. 8 shows the flow path of fuel passing through the fuel pumping ball.

The direction of fuel through the carburetor is as follows: the fuel came from a fuel tank flows into the fuel inlet tube, then flows along the fuel passage molded integrally with the carburetor body to enters the measuring room, referring to FIG. 8, the fuel then enters the fuel pumping ball from the measuring room via one fuel pipe 10, and the fuel later flows along the other fuel pipe 10 connecting with the carburetor body to enter the carburetor body, the fuel further enters the shut-off device 9 with its opening or closing controlled by the recess 401, finally, the main fuel supply cavity receives the fuel.

The foregoing description of the present invention has been presented for the purpose of illustration and description. It is not intended to be exhaustive to limit the invention to the precise form disclosed, and obviously many modifications and variations are possible in light of the above teaching. Such modification and variations that may be apparent to those skilled in the art are intended to be included within the scope of this invention as defined by the accompanying claims.

What is claimed is:

1. A simple start ratchet carburetor comprising:

a carburetor body;

an inlet tube communicated with the carburetor body for forming a fuel passage;

a fuel passage of a measuring room arranged in the carburetor; and a main fuel supply cavity molded integrally with the carburetor body, which comprises a choke subassembly, a venturi, and a throttle subassembly, with the choke subassembly comprising a choke plate and a choke shaft, and the choke plate being mounted on the choke shaft, the throttle subassembly comprising a throttle plate and a throttle shaft, and the throttle plate being mounted on the throttle shaft by a screw, the choke shaft and the throttle shaft both being pivotally connected to the carburetor body, and two ends of both the choke shaft and the throttle shaft being protruded from the carburetor body to form linkage ends and control ends respectively;

wherein the end of the throttle shaft protruding from the carburetor body provides a first pawl, a second pawl and a hand cranking block, the first pawl and the second pawl both are mounted on one end of the throttle shaft by a fastener which limits the location between the pawls and the throttle shaft, while the hand cranking block is mounted on the other end of the throttle shaft, the end of the choke shaft protruding from the carburetor body provides a first ratchet and a second ratchet, the first ratchet and the second ratchet are mounted on one end which is the same end for the first pawl and the second pawl to mount thereon of the throttle shaft, by a fastener which limits the location between the ratchets and the choke shaft, the carburetor body further comprises an air removing device consisting of fuel pipes, a valve rod, a swing block, a fuel pumping ball seat and a fuel pumping ball located on the fuel pumping ball seat, two ends of each fuel pipe are connected with the fuel pumping ball seat and the carburetor body respectively to form a fuel passage, one end of the valve rod is mounted on the fuel pumping ball seat, and the other end has a flexible connection with the swing block, the movement of the swing block provided by the air removing device drives the first ratchet, the second ratchet, the first pawl and the second pawl which forms a ratchet mechanism;

the carburetor body further comprises a shut-off valve device, the air removing device drives the first ratchet and the second ratchet, so as to rotate the choke shaft, then the choke shaft controls the opening or closing of the shut-off valve device.

2. The simple start ratchet carburetor as claimed in claim 1, wherein the edge of the second ratchet consists of twelve teeth, and the profile angle between two teeth is 25°, while the first ratchet has a step, at least one tooth and a notch between them, the first ratchet is mounted between the carburetor body and the second ratchet.

3. The simple start ratchet carburetor as claimed in claim 1, wherein the choke shaft consists of a choke linkage shaft and a choke control shaft which could move relative to the choke linkage shaft, the choke linkage shaft is located through the choke control shaft and is arranged in the carburetor body, the end of the choke control shaft located in the carburetor body provides an open slot, while the inner cavity of the choke plate provides a protrusion that locks with the open slot, one end of the choke plate is pressed against a toroidal step provided by the choke linkage shaft, and the other end is pressed against the open slot provided by the choke control shaft.

4. The simple start ratchet carburetor as claimed in claim 3, wherein the choke linkage shaft has a recess, the recess is presented as a semi-torus structure.

5. The simple start ratchet carburetor as claimed in claim 1, wherein the shut-off valve device consists of a fuel passage molded integrally with the carburetor body, and a needle valve, a valve seat and a flexible element within the fuel passage, the cavity of the valve seat provides a movable block which has the needle valve inserted therein, one end of the flexible element is elastically pressed against the fuel passage, and the other end is elastically pressed against a locating torus provided by the valve seat, the shut-off valve device is connected with the main fuel supply cavity via a fuel passage.

6. The simple start ratchet carburetor as claimed in claim 5, wherein there is a line contact or a surface contact between a choke linkage shaft recess and the outer surface of the valve seat.

7. The simple start ratchet carburetor as claimed in claim 5, wherein a pressure spring is provided between the cavity of the seat and the movable block.

8. The simple start ratchet carburetor as claimed in claim 6, wherein a pressure spring is provided between the cavity of the seat and the movable block.

* * * * *